US005114196A

United States Patent [19]

Storer

[11] Patent Number: 5,114,196

[45] Date of Patent: May 19, 1992

[54] TAMPER DETERRENT LOCKING DEVICE AND METHOD OF USING

[75] Inventor: Clyde K. Storer, Columbus, Ohio

[73] Assignee: The Buckeye Stamping Company, Columbus, Ohio

[21] Appl. No.: 746,901

[22] Filed: Aug. 19, 1991

[51] Int. Cl.[5] ..... B65D 33/34

[52] U.S. Cl. ..... 292/307 R

[58] Field of Search ..... 292/307, 311, 313, 315, 292/317, 326

[56] References Cited

U.S. PATENT DOCUMENTS

| | | | |
|---|---|---|---|
| 2,809,065 | 10/1957 | Erke | 292/307 R |
| 3,770,307 | 11/1973 | Van Gompel | 292/307 R |
| 3,779,589 | 12/1973 | Patterson | 292/317 |
| 4,674,778 | 6/1987 | Ruiz | 292/256.6 |
| 4,883,295 | 11/1989 | Kesselman | 292/307 R |
| 4,940,268 | 7/1990 | Lesquir et al. | 292/317 |
| 5,020,342 | 6/1991 | Doan et al. | 292/307 R |

*Primary Examiner*—Richard E. Moore
*Attorney, Agent, or Firm*—Sidney W. Millard

[57] ABSTRACT

A tamper deterrent locking device includes a cable secured to a female member, the cable forming a loop projecting from the female member with the free end thereof projecting through an aperture in the female member. The male member fits into the aperture to frictionally lock the cable between the male and female members. The loop is passed through two aligned holes in two pieces of relatively movable apparatus whereby one who moves said relatively movable pieces is required to sever the cable or disengage it from the frictional engagement.

20 Claims, 1 Drawing Sheet

TAMPER DETERRENT LOCKING DEVICE AND METHOD OF USING

FIELD OF THE INVENTION

This invention relates to a tamper evident locking device including a cable which passes through two aligned holes in two relatively movable pieces of apparatus. The cable forms a loop with each end secured to a seal. Thus, relative movement between the pieces of apparatus having the aligned holes requires a severing of the cable or a disengagement of the cable from the seal. Either alternative alerts the next user of the apparatus to possible tampering.

BACKGROUND OF THE INVENTION

It is important in various industries for a customer receiving a shipment of goods on a railroad car or a trailer to expect the shipper to mechanically lock the door of the car or trailer by a tamper proof device to provide evidence to the customer that the contents of the car or trailer have not been changed since the time they were dispatched by the shipper. Similar devices are used at a part separation line in gas meters, electric meters, etc. to make sure there has been no tampering by vandals or the like.

The most well known seal device for this purpose involves a pre-formed lead seal having one end of a flexible cable secured therein. The free end of the cable projects through aligned holes in the handle, door or frame of the railroad car or trailer or between two separable housing parts of the meter. The free end of the cable then passes through an opening in the lead seal and the lead seal is deformed to frictionally lock the two ends of the cable therein. In order to move the two relatively movable pieces of the apparatus to be sealed, a person is required to sever the cable or disengage one end of the cable from the deformed lead seal. Thereby, any person observing the severed locking device is alerted to a prior opening.

U.S. Pat. No. 2,809,065 discloses two plastic parts having unique wedge-shaped configurations and a strip intermediate the two having flanged, serrated and wedge-shaped surfaces to lock the strip to the two plastic parts forming the seal. The strip passes through holes in apparatus to be secured. After the strip is secured to the two plastic parts and they are secured together, the strip must be severed or the plastic parts destroyed to open the secured apparatus.

U.S. Pat. No. 3,770,307 discloses a cable lock and seal device which comprises a flexible cable and an enclosure fixedly secured to one end of the cable. A passage extends through the enclosure and is proportioned slidably to receive the distal end portion of the cable therethrough. A wedge element and a disk-shaped jam element are sealed within the enclosure, the wedge element including a ramp surface disposed at a small angle with respect to the passage and laterally spaced apart therefrom. The jam element is frictionally engaged between the ramp surface and cable portion whereby, movement of the cable through the passage in one direction causes movement of the jam element laterally away therefrom and movement of the cable in a direction opposite the aforementioned direction causes movement of the jam element laterally toward the cable to thereby jam the cable between the passage walls and the jam element so as to prevent further movement thereof in that direction.

U.S. Pat. No. 4,674,778 discloses a locking ring formed of a plurality of curved clamp portions connecting in an end-to-end relationship for securing an electrical power measuring device with a mounting base. The semi-circular clamp portions are molded from a single piece of plastic, are identical in construction and are fully interchangeable. Each clamp is preferably formed with a semi-circular curved arc body having a male connection at one end and a female connection at the other end. The male end is formed with a pair of projections of which the first male projection serves as an alignment guide during make-up and use while the second male projection carries a movable latch shoulder for effecting the end-to-end connection with the adjacent mating clamp portion. The female end includes a housing having a central opening with separated first and second entrances formed by a roof mounted lug. The lug also forms a locking surface for engaging with the latch surface of the second male projection of the adjacent clamp portion to operably connect the clamp portions. A tampering indicating locking block is forced into the second entrance after the clamp portions are connected to block movement of the second male projection that would disengage the latch shoulder.

U.S. Pat. No. 4,883,295 discloses a tamper deterrent assembly which is molded of plastic material and includes a body member with an enclosed locking space having an open end. The open end is closed by a closure member mounted on the body member and movable toward a closed end of the locking space. The closure member is normally retained on the body member in a first position and may be moved to a locking position where a strip engaging unit carried by the closure member is received and locking by a locking unit. The locking unit may be carried by an elongated locking strip which is inserted into the locking chamber through a strip receiving slot in the body, or the strip engaging unit may pass through the locking strip and engage a locking unit carried on an end wall of the body.

What is needed in the industry is a simpler locking device to serve the desired purpose and this invention fills that need.

SUMMARY OF THE INVENTION

A flexible cable has one end secured to a plastic female member by an over-sized bead and the other end is configured to be frictionally locked in the female member in an aperture substantially filled by a male member.

The cable projects through an opening in the female member, which opening is smaller than the over-sized bead. Thereby, the cable passes through the opening but the bead cannot. The secured cable is designed to have its distal end slip through aligned holes in two relatively movable parts of an apparatus to be secured by the tamper deterrent locking device.

The female member has an aperture with an internally and transversely extending ridge therein.

The cable projects from the female member through the two holes in the relatively movable pieces of apparatus, and doubles back through the aperture or a second opening in the female member where it is frictionally locked in place by the insertion of a male member of about the same configuration of the aperture. After it is completely inserted in the aperture, the male member is locked in place in the female member by an integral groove designed to receive the transversely extending ridge.

The male and female members are of solid but resilient plastic material and when the male member is inserted it frictionally engages the cable between the facing surfaces of the male member and the walls of the aperture. The male member is wedge-shaped at its forward end so that it cams the sides of the female member outwardly as it slips past the transversely extending ridge. The ridge ultimately snaps into place in the groove intermediate the innermost and outermost ends of the male member. That locks the male and female members together with the cable frictionally held between the two.

Objects of the invention and the scope of applicability of the present invention will become apparent from the detailed description to follow taken in conjunction with the accompanying drawings in which like parts are designated by like reference characters.

BRIEF DESCRIPTION OF THE DRAWINGS

For a fuller understanding of the nature and objects of the invention, reference should be had to the following detailed description taken in connection with the accompanying drawings wherein.

Figure 1:
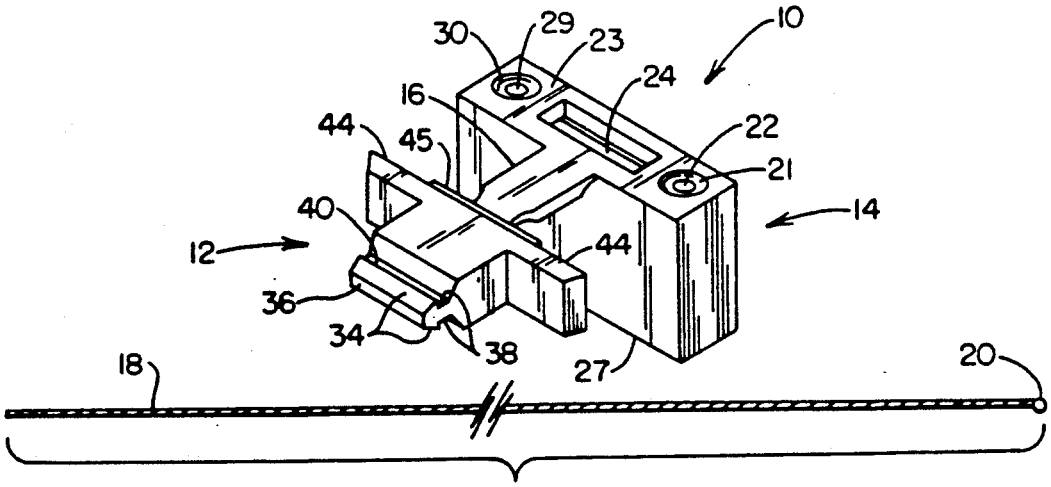
FIG. 1 is a perspective view of an injection molded preform for both male and female members of the locking device of invention; the cable is shown separately adjacent the pre-form.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words connected, secured or terms similar thereto are often used. They are not limited to direct connection but include connection through other elements where such connection is recognized as being equivalent by those skilled in the art.

DETAILED DESCRIPTION OF THE PREFERRED EMBODIMENT

FIG. 1 illustrates a pre-form 10 of the two injection molded male and female members of the locking device of this invention. The male member 12 is secured to the female member 14 by a bridge member 16 which will be broken off and discarded upon the locking device being used for its intended purpose. The bridge member serves a useful purpose because it holds the two parts together as a unit until the time they are to be used. Thereby, the purchaser of the product is required to carry only one bag of plastic parts and one bag of flexible metal cables, but the worker does not have to fish around in a bag of plastic pieces trying to find two separate plastic parts at the time he wants to use them. In actual practice the cables and pre-forms may be in the same bag or box but that is immaterial to this invention.

A flexible metal cable 18 has a bead 20 on one end. The purpose of the bead 20 is to secure the cable 18 to the female member 14 when the cable is inserted through a first opening 22. It will be observed that the cable 18 is smaller in diameter than first opening 22, but the bead 20 is larger, thereby, the cable may pass through opening 22 but the bead cannot. A countersink 21 facilitates insertion of the cable and allows bead 20 to sit in the countersink below the top surface 23 of female member 14. An oversized bead is not the only means for preventing cable 18 from passing through opening 22. A crimp in the cable may serve the same purpose. Any other means to accomplish the same result is within the inventive concept.

Figure 5:
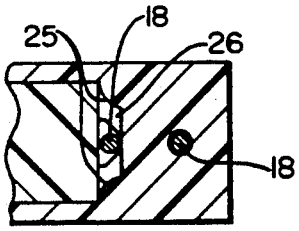
FIG. 5 is a fragmentary view, partially in section, taken along line 5—5 of FIG. 4.
Figure 2:
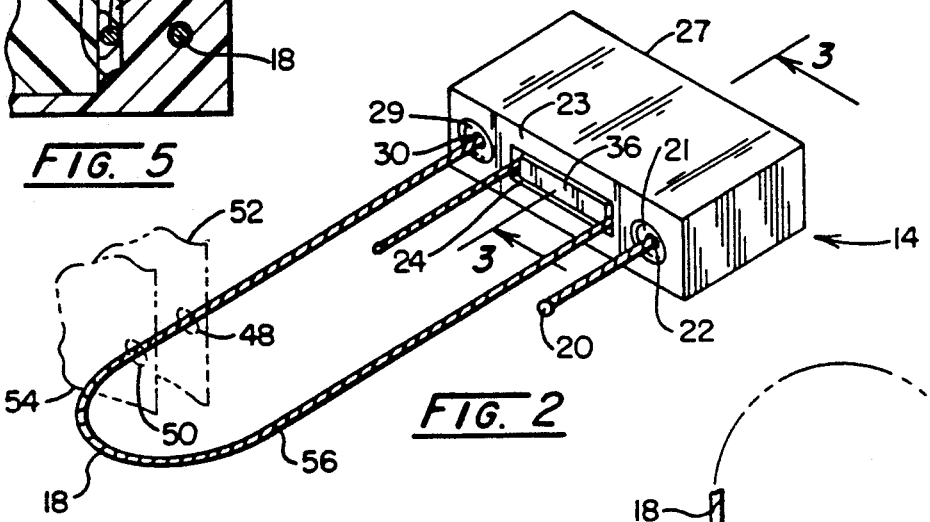
FIG. 2 is a perspective view of the locking device of this invention shown in locked operative position.
Figure 3:
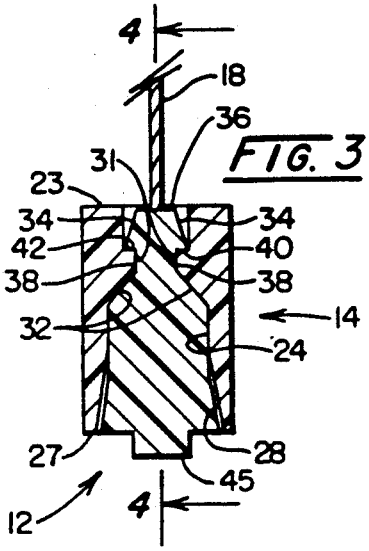
FIG. 3 is a sectional view taken along line 3—3 of FIG. 2.

The female member has a generally rectangular aperture 24 having inwardly bulging corners 25 (best seen in FIG. 5). Corners 25 provide slots 26 therebetween at each end of aperture 24 to accommodate the wire cable 18 passing therethrough. Toward the lower surface 27 of the female member the aperture 24 opens into a cavity 28.

Note should be taken of the symmetry of the female member 14 which includes a second opening 29 being generally parallel with, and similarly shaped, to first opening 22. Thereby, the operator may use either of the two openings as the "first opening" without having to analyze the configuration thereof. A similar countersink 30 appears in surface 23 around opening 29.

Within aperture 24 are a pair of ridges 31 projecting inwardly from the surface of the aperture. Each ridge 31 has a slopping cam surface 32 facing toward cavity 28. The purpose of cam surfaces 32 is to cooperate with a wedge-shaped surface 34 on the male member 12.

Male member 12 has its forward end 36 with the two tapered surfaces 34 immediately downstream of a pair of grooves 38. The forward end of each groove includes a shoulder 40 which is generally perpendicular to the axis of the male member 12. Shoulders 40 are designed to snap into place behind flange surfaces 42 on the downstream side of aperture 24. Flange surfaces 42 extend generally perpendicular to the axis of aperture 24.

The cavity 28 in the upstream side of the female member 14 is of greater cross-sectional area than the aperture 24. The sidewalls of cavity 28 converge toward aperture 24 at an angle of about 9¼° and the mating surfaces of the male member are similarly sloped.

It will be observed that transversely projecting arms 44 on the generally T-shaped male member are configured to fit into the cavity 28 in close fitting relationship whereby when the two plastic members are conjoined in operative relationship, the periphery of the male member does not extend beyond the periphery of the female member except for the non-functional molding knob 45.

Figure 4:
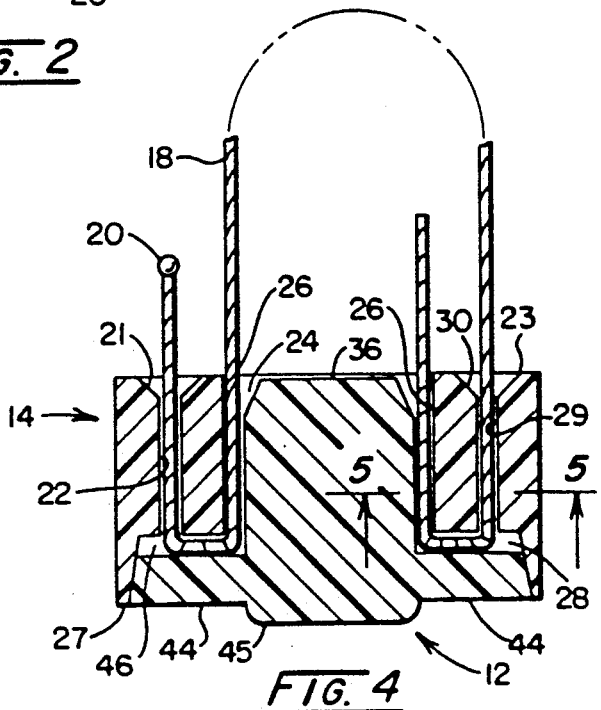
FIG. 4 is sectional view taken along line 4—4 of FIG. 3.

In operation, the cable 18 is inserted through the first opening 22 until the bead 20 engages the 45° angled countersink surface 21 of the female member with the distal end of the cable extending well beyond the cavity 28. Next the cable is bent to extend back through the female member a second time (best seen in FIG. 4), passing through the slot 26. For best performance, the cable is pulled tight such that the bead fits tightly in countersink 21 of first opening 22 and the cable fits against the bottom 46 of the cavity 28 or nearly so.

The end of the cable projecting outwardly from slot 26 is inserted through aligned holes 48 and 50 in two relatively movable parts 52 and 54 of the apparatus to be secured by the tamper deterrent locking device.

After extending through holes 48 and 50 the free end of the cable is inserted through the female member a third time to provide a closed loop 56. After the loop 56 is pulled to a suitably tight position, the free end of the cable is inserted through the female member for a fourth time, whereby the free end of the cable extends from the periphery of the female member at the same surface as engages bead 20. In the illustrated embodiment the third pass through the female member is through second opening 29. Countersink 30 serves the same insertion facilitating purpose as disclosed for countersink 21. However, the third pass may be through aperture 24 and the fourth pass through opening 29 if desired.

At this point the male member is inserted into the female member with the forward end 36 moving past the 45° angled cam surfaces 32 as the 45° angled wedge-shaped surfaces 34 resiliently deform the sidewalls of the aperture 24 in a radially outward direction until the wedge-shaped surfaces 34 move past flange surfaces 42, and at that point, the ridges 31 snap back into place in grooves 38 where shoulders 40 engage flange surfaces 42 to prevent disengagement of the male and female members without destruction of the same. The knob 45 is the only part of the male member which extends beyond the periphery at this point. Knob 45 is a non-functional element in the operative combination and for all practical purpose is non-existent.

By appropriate dimensional relationships the transversely extending arms 44 fit snugly into cavity 28 and thereby prevent access by vandals or the like who might try to disengage the two parts.

With the male member in place the cable 18 is frictionally engaged by the surfaces of the slots 26 of aperture 24 and the male member 12, and in addition, the several looped configurations of the cable within the cavity 28 combine to minimize the possibility of the cable being pulled from its frictionally locked position.

Having thus described the apparatus and procedural steps for carrying out the invention, it will be clear to those having ordinary skill in the art, that various modifications may be made in the apparatus and the procedural steps without departing from the inventive concept. It is not intended that the words used in the specification to describe the invention, nor the drawings illustrating the same, be limiting on the invention. Rather it is intended that the invention be limited only by the scope of the appended claims.

I claim:

1. A tamper deterrent locking device comprising a flexible cable and two solid resilient parts wherein, said cable includes first and second ends, one part being a partially wedge-shaped member of a size and configuration to penetrate an aperture in the other part, said aperture including an inwardly extending ridge, said wedge-shaped member including a groove along one side of a size to receive and hold said ridge upon said wedge-shaped member being forced into said aperture to the extent that said groove slips into place to accommodate said ridge, a first opening in said other part with said cable projecting through said opening, said cable being first bent to project through said aperture a second time and then doubled back to pass through said other part a third time to provide a cable loop projecting from said other part, the relative sizes of said wedge-shaped member and said aperture being such that with said wedge-shaped member in place with the ridge in the groove the surfaces of the aperture and wedge-shaped member frictionally engage said cable to lock said cable in said aperture.

2. The device of claim 1 wherein said third pass of said cable through said other part is through said aperture, thereby leaving a closed loop of cable extending from said aperture, said loop being closed by said wedge-shaped member.

3. The device of claim 2 including a second opening through said other part, said second opening being generally parallel to, spaced from, and of about the same configuration as said first opening, said cable extending through said second opening to thereby pass through said other part for a fourth time.

4. The device of claim 3 including means forming a cavity in said other part for receiving a transversely extending arm on said wedge-shaped member.

5. The device of claim 4 wherein said wedge-shaped member is generally T-shaped with two arms extending transversely therefrom, said cavity means and aperture being configured to receive said wedge-shaped member and arms with substantially no functional portion of said wedge-shaped member extending beyond the periphery of said other part.

6. The device of claim 1 including a second opening through said other part, said second opening being generally parallel to, spaced from, and of about the same configuration as said first opening, said cable extending through said second opening to thereby pass through said other part for said third time.

7. The device of claim 6 including means forming a cavity in said other part for receiving a transversely extending arm on said wedge-shaped member.

8. The device of claim 7 wherein said wedge-shaped member is generally T-shaped with two arms extending transversely therefrom, said cavity means and aperture being configured to receive said wedge-shaped member and arms with substantially no portion of said wedge-shaped member extending beyond the periphery of said other part.

9. The device of claim 1 including means forming a cavity in said other part for receiving a transversely extending arm on said wedge-shaped member.

10. The device of claim 9 wherein said wedge-shaped member is generally T-shaped with two arms extending transversely therefrom, said cavity means and aperture being configured to receive said wedge-shaped member and arms with substantially no portion of said wedge-shaped member extending beyond the periphery of said other part.

11. The device of claim 2 including means forming a cavity in said other part for receiving a transversely extending arm on said wedge-shaped member.

12. The device of claim 11 wherein said wedge is generally T-shaped with two arms extending transversely therefrom, said cavity means and aperture being configured to receive said wedge-shaped member and arms with substantially no portion of said wedge-shaped member extending beyond the periphery of said other part.

13. A method of locking device to apparatus for providing an indication of tampering with said apparatus comprising, providing two aligned holes in relatively movable pieces of said apparatus, providing a locking device which includes a flexible cable having two ends, a male part and a female part having an aperture therethrough, forming a bead on said one end of said cable, securing said cable to said female member by inserting the other cable end through an opening therethrough, said opening being of a smaller configuration than said bead, moving said other end of said cable through said aperture and thereafter inserting it through said holes in said pieces of apparatus, then inserting said other end through said aperture again, inserting said male member through said aperture in said female member to frictionally lock said cable in said aperture.

14. The method of claim 13 including inserting said other cable end through a second opening in said female member at a time after its two insertions through said aperture.

15. The method of claim 14 including forming a cavity in said female member aligned with said aperture, providing a radially extending arm on said male member conforming in size and shape to said cavity, inserting said male member into said aperture and cavity until said male member substantially ceases to project from the periphery of said female member.

16. The method of claim 15 including configuring said arms and cavity to cover two U-shaped turns of said cable exiting, said aperture.

17. The method of claim 16 including locking said male and female members together by, providing an inwardly projecting ridge in said aperture, providing a groove in the surface of said male member, inserting said male member into said female member until said ridge slips into said groove.

18. The method of claim 13 including locking said male and female members together by, providing an inwardly projecting ridge in said aperture, providing a groove in the surface of said male member, inserting said male member into said female member until said ridge slips into said groove.

19. The method of claim 14 including locking said male and female members together by, providing an inwardly projecting ridge in said aperture, providing a groove in the surface of said male member, inserting said male member into said female member until said ridge slips into said groove.

20. The method of claim 15 including locking said male and female members together by, providing an inwardly projecting ridge in said aperture, providing a groove in the surface of said male member, inserting said male member into said female member until said ridge slips into said groove.

* * * * *